US007368646B2

(12) United States Patent
Payung

(10) Patent No.: US 7,368,646 B2
(45) Date of Patent: May 6, 2008

(54) STRINGED MUSICAL INSTRUMENT

(76) Inventor: Mark C. Payung, 850 Route 130 North, Burlington, NJ (US) 08016

( * ) Notice: Subject to any disclaimer, the term of this patent is extended or adjusted under 35 U.S.C. 154(b) by 0 days.

(21) Appl. No.: 11/055,126

(22) Filed: Feb. 9, 2005

(65) Prior Publication Data

US 2006/0174744 A1 Aug. 10, 2006

(51) Int. Cl.
*G10D 3/00* (2006.01)

(52) U.S. Cl. ..... 84/290; 84/314 R

(58) Field of Classification Search ..... 84/290, 84/173, 189, 197, 199, 209, 213, 291, 299, 84/304, 307, 314 R
See application file for complete search history.

(56) References Cited

U.S. PATENT DOCUMENTS 2,539,297 A * 1/1951 De Lazaro ..... 84/731
3,139,476 A * 6/1964 Alvarez ..... 84/726
4,064,780 A * 12/1977 Bond ..... 84/314 R
4,213,370 A * 7/1980 Jones ..... 84/291
4,429,608 A * 2/1984 Kaman et al. ..... 84/291
4,735,124 A * 4/1988 Bernier ..... 84/304
5,072,643 A * 12/1991 Murata ..... 84/293
5,977,462 A * 11/1999 Wolfson ..... 84/267
6,350,940 B1 * 2/2002 Upchurch et al. ..... 84/314 R
6,657,113 B2 12/2003 Herman
2002/0088331 A1 * 7/2002 Pecanic ..... 84/307
2005/0188813 A1 * 9/2005 Klanner ..... 84/297 R

OTHER PUBLICATIONS

Ned Evett's Glass Guitar Gallery, NedEvett.com, 2004.

* cited by examiner

*Primary Examiner*—Lincoln Donovan
*Assistant Examiner*—Jianchun Qin
(74) *Attorney, Agent, or Firm*—DLA Piper US LLP

(57) ABSTRACT

A stringed musical instrument includes a string which, when vibrated, produces sound. Both ends of the vibrating portion of the string touch glass.

17 Claims, 5 Drawing Sheets

STRINGED MUSICAL INSTRUMENT

FIELD OF THE INVENTION

The present invention relates to stringed musical instruments and in particular stringed musical instruments which include components made from glass materials. Specifically, a stringed musical instrument is disclosed where both ends of the strings touch glass.

BACKGROUND OF THE INVENTION

A variety of stringed instruments are well known for producing musical notes. In these musical instruments, a string is held between two points. The string is caused to vibrate. Vibration of the string causes the production of a musical sound.

A common stringed musical instrument is the guitar. Other stringed instruments are orchestral instruments and include the viola, violin, cello, and base. Many stringed instruments include a finger board, which is typically a long strip of wood against which strings are pressed during play of the instrument. On guitars, the finger board is fitted with small frets against which the strings are pressed so as to produce different musical notes when the strings are plucked on strummed. In violins and cellos, however, the finger board does not include frets. Thus, the musician presses the string against the finger board at exactly the right location so that, when the string is caused to vibrate, the string will produce a note at the desired frequency.

In the guitar and in the orchestral instruments, the strings produce notes by being plucked or strummed. Furthermore, in the orchestral instruments, those instruments produce sound by rubbing a bow against the strings. This causes those strings to vibrate.

A further well known stringed instrument is the piano. In the piano, strings are held taunt between two locations. To produce musical notes, keys are depressed which actuate hammers, which, in turn, strike the strings. By striking the strings with the hammers, the strings produce musical notes.

An interesting guitar is known thanks to the work of musician Ned Event. In the Event guitar, the finger board is made of glass. Furthermore, the finger board does not include frets. Thus, for the guitar to produce the correct notes, the guitar strings are pressed by fingers against the glass finger board at exactly the right locations.

SUMMARY OF THE INVENTION

A stringed musical instrument includes a string which, when vibrated, produces sound. Both ends of the vibrating portion of the string touch glass.

DETAILED DESCRIPTION OF THE INVENTION

Detailed views of several exemplary embodiments of the present invention are illustrated by FIGS. 1-11.

In order to simplify this explanation, exemplary embodiments of the present invention will be described with reference to a guitar. Subsequently, a brief explanation will be made which relates to the present invention when used with orchestral stringed instruments.

The methodology for making stringed musical instruments, such as guitars, is well known in the art, and the specifics of how such stringed musical instruments is made will not be described here. For a general description of the manufacture of guitars, the publication Koch, Martin, Building Electric Guitars, 2001 (ISBN 3-901314-07-5) is incorporated by reference for its teachings regarding the manufacturer of a guitar. The aforementioned publication provides information on how a guitar is built. The following description refers to modifications to the prior art process of manufacturing musical instruments.

Figure 1:
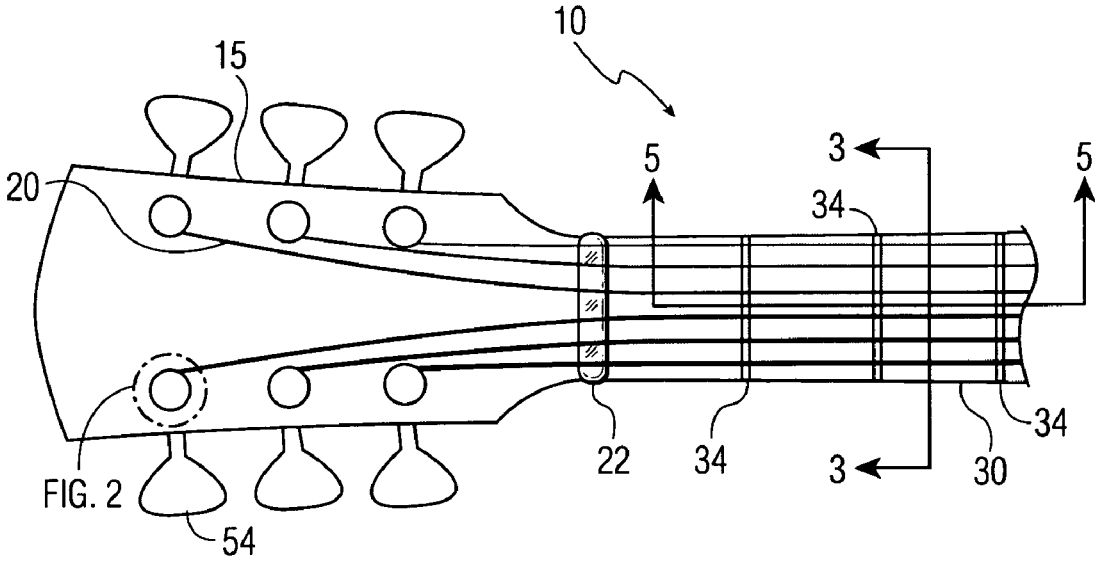
FIG. 1 is a top view of a peg head and a portion of a stringed instrument neck in accordance with an exemplary embodiment of the present invention.

FIG. 1 is a top view which illustrates an exemplary embodiment of the present invention. In FIG. 1, a portion of guitar 10 is shown. Guitar 10 includes peg head 15. A plurality of tuning pegs 56 are coupled to peg head 15. Each peg 56 is also coupled to respective knob 54. By turning knob 54, tuning peg 56 also rotates.

Figure 2:
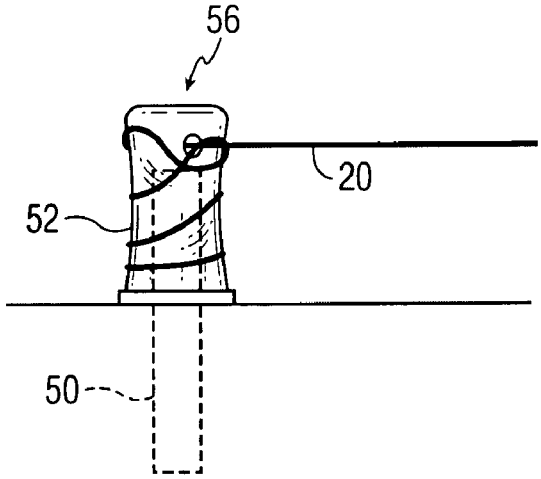
FIG. 2 is a side view of a tuning peg in accordance with a further exemplary embodiment of the present invention.

In an exemplary embodiment of the present invention, peg 56 includes peg shaft 50 and shaft cover 52 secured thereon. Shaft cover 52 may include glass materials. The use of shaft cover 52 is optional. This is shown in FIG. 2.

Coupled to each tuning peg 56 is respective string 20. String 20 may engage page 56 through a hole formed thereon. Thus, by rotating knob 54, the tension on respective string 20 can be increased and decreased.

Some portions of the interface between knob 54 and tuning peg 50 are not shown in FIG. 1. This interface, however, is understood to one of ordinary skill in the art.

Moving from tuning peg 56, each string 20 is in contact with bridge 22. In an exemplary embodiment of the present invention, bridge 22 is a glass component.

Suitable glass components that can be used to manufacture bridge 22 are known in the art. An exemplary glass component is made of Pyrex and is manufactured by Corning Glass Company of Corning, N.Y. As another example, bridge 22 can be formed from a glass resin composite. Such a composite, for example, is described in U.S. Pat. No. 6,657,113 which is incorporated by reference for its teachings on molded frets. It is understood that other methodology for molding components that include glass are known to one of ordinary skill in the art.

After stretching across bridge 22, each string 20 proceeds along a board unit which is represented in FIG. 1 as neck 30. As string 20 proceeds along neck 30, string 20 stretches across frets 34. When playing the musical instrument, fingers, for example, are used to press strings 20 against neck 30 so that one or more strings 20 touch one or more frets 34.

In an exemplary embodiment of the present invention, fret 34 also includes glass materials.

Figure 3:
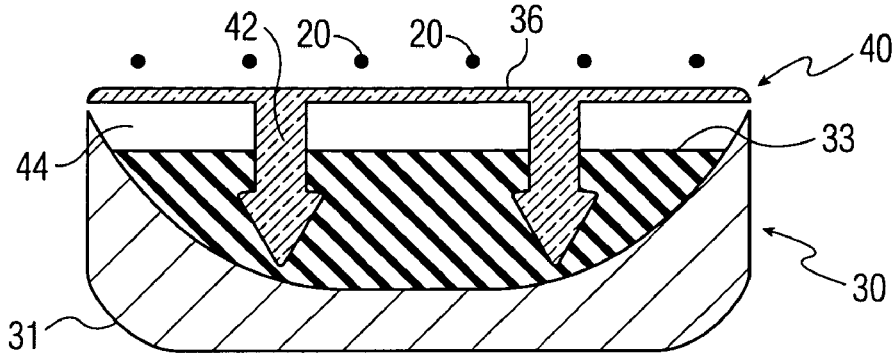
FIG. 3 is a cross-sectional view of cross-section 3-3 of FIG. 1.

FIG. 3 is a cross-sectional view of neck 30 taken along section line 3-3 of FIG. 1. In FIG. 3, cross-sections of strings 20 are shown suspended over neck 30. Because strings 20 are suspended over neck 30, top air gap 32 may be defined. Below top gap 32, glass tile 36 may be found to form a finger board. Glass tile 36 includes extension members 42. Extension members 42 may engage tile holder 33 using, for example, a compression or a friction fitting. Tile holder 33 may be made of a variety of materials including, but not limited to, hardened rubber. Tile holder 33 may be coupled to neck base 31. Neck base 31 can also be made of a variety of materials including, but not limited to, wood. Bottom air gap 44 is defined by the space between tile 36 and tile holder 33.

FIG. 3 illustrates neck 30 according to one exemplary embodiment of the present invention. In an alternative embodiment of the present invention, neck 30 is made of another material such as, for example, wood. Thus, the exemplary embodiment illustrated in FIG. 3 is not intended as a limitation on the possible materials or configuration which may be used in manufacturing neck 30.

Figure 4:
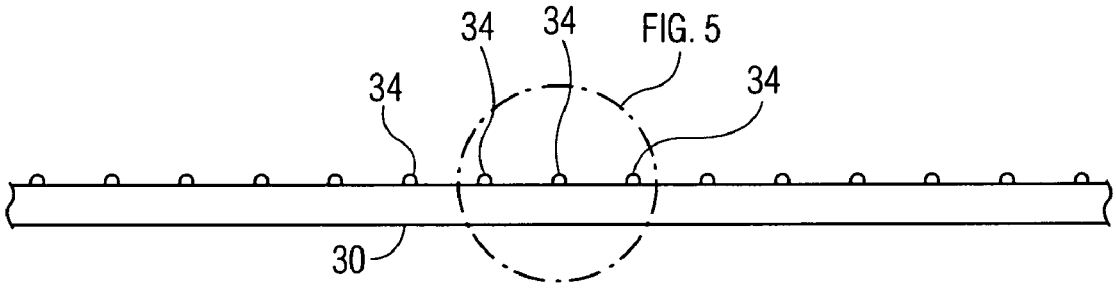
FIG. 4 is a side view of a musical instrument neck.

FIG. 4 is a side view of neck 30. As shown, neck 30 includes frets 34. Thus, in one exemplary embodiment of the present invention, a specifically shaped orifice can be formed in the neck and each fret can be slid into the orifice. Alternatively, the frets can be situated in the neck using other methods that are known to one of ordinary skill in the art.

Figure 5:
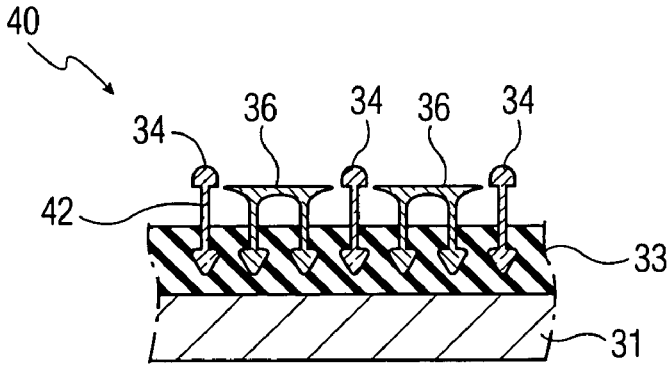
FIG. 5 is a cross-sectional view of section 5-5 of FIG. 1.

FIG. 5 illustrates a cross-sectional side view of neck 30 according to a further exemplary embodiment of the present invention. The cross-sectional view shown in FIG. 5 is taken along section line 5-5 of FIG. 1.

In FIG. 5, neck base 31 is again shown. Above neck base 31 may be optionally situated tile holder 33. Glass tiles 36 and frets 34 are included. Extending from glass tiles 36 and frets 34 are extension members 42. Again, extension members 42 may engage tile holders 33 using a force fitting or a friction fitting. Again, the embodiment shown in FIG. 5 is merely exemplary.

Figure 6:
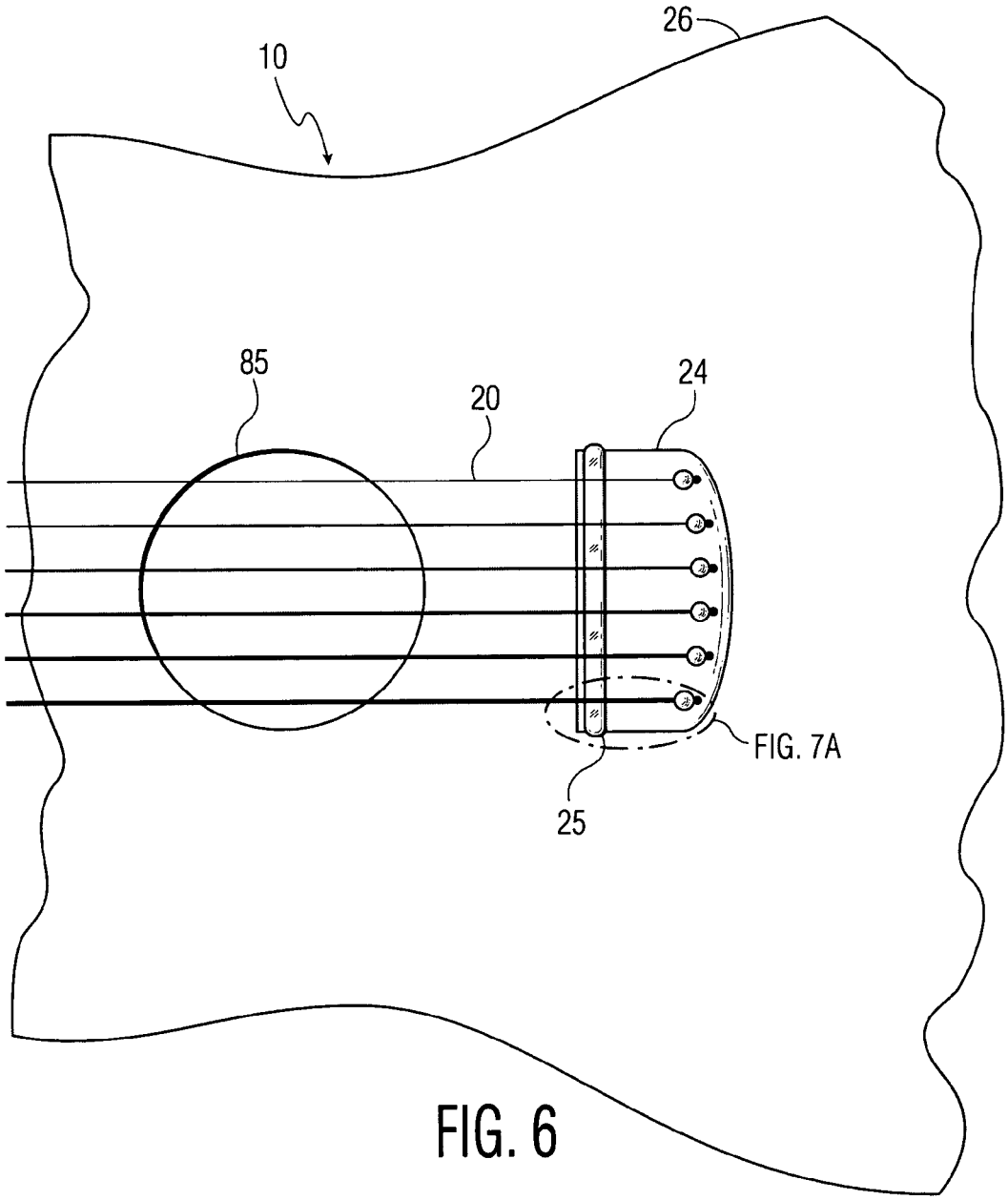
FIG. 6 is a top view of a portion of a body of a musical instrument in accordance with an exemplary embodiment of the present invention.
Figure 7A:
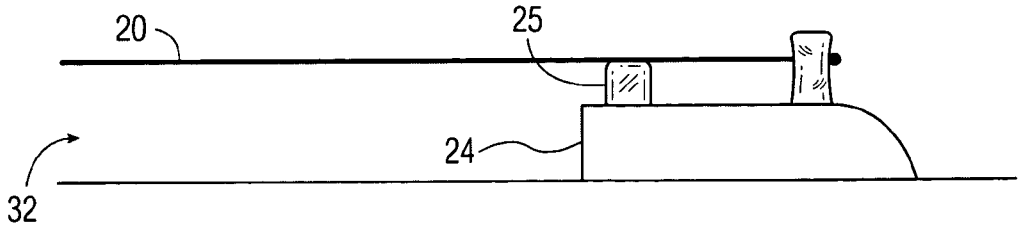
FIG. 7A is a partial side view of the musical instrument body shown in FIG. 6.

FIG. 6 illustrates body 26 of guitar 10 in accordance with the exemplary embodiment of the present invention. Strings 20 may stretch across optional opening 85 until they touch saddle fret 25. Thus, saddle fret 25 touches strings 20. Saddle fret 25 may include glass materials as has been previously described. After extending across saddle fret 25, strings 20 may terminate at saddle 24. Typically, as shown in FIG. 7A, there are openings formed in saddle 24 and a bulging section of each string 20 holds each string 20 in place relative to saddle 24. Saddle 24 may also include glass materials.

Figure 7B:
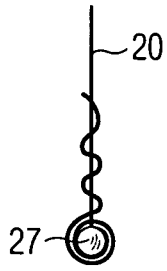
FIG. 7B illustrates a string in accordance with an exemplary embodiment of the present invention.

An exemplary string is illustrated in FIG. 7B. The bulging section referred to above is formed by wrapping string 20 around circular member 27 (1 or multiple times) and then winding the trailing end of string 20 about itself. In an exemplary embodiment of the present invention, circular member 27 includes glass materials.

Figure 8:
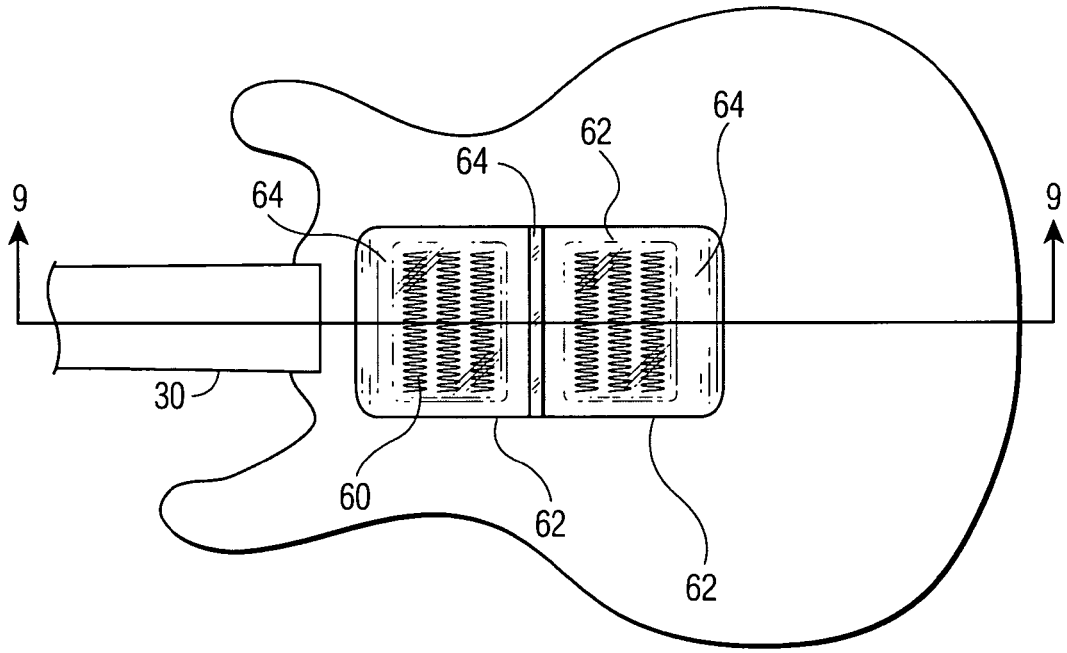
FIG. 8 is a top view of a musical instrument body in accordance with a further exemplary embodiment of the present invention. This further exemplary embodiment includes pickup coils.
Figure 9:
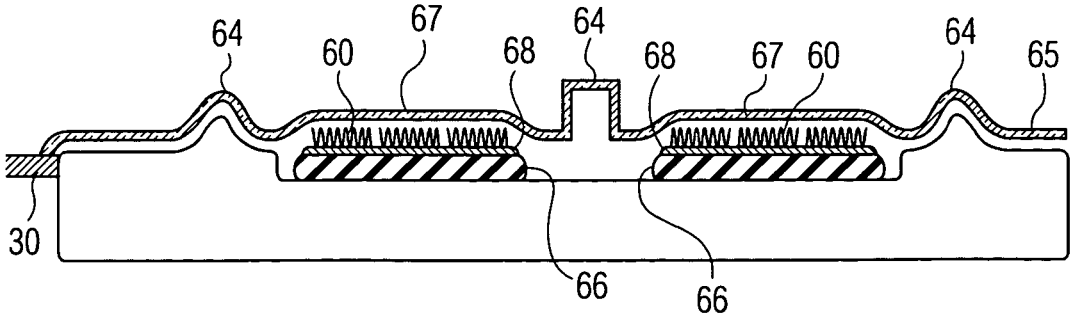
FIG. 9 is a cross-sectional view of section 9-9 of FIG. 8.

A further exemplary embodiment of the present invention is shown with reference to FIG. 8. In the exemplary embodiment shown in FIG. 8, pickup coils 60 are included. Pickup coils are also shown in FIG. 9, which is a cross-sectional view of FIG. 8 taken along section line 9-9. Coils 60 are situated above magnets 68. Each magnet 68 is situated above pickup coil base 60. The use of pickup coils is known to one of ordinary skill in the art.

As shown in FIGS. 8 and 9, optional raised glass sections 62 are included. Optional raised glass sections 62 may be situated on opposite sides of pickup coil 60 and extend orthogonally from body 26. In addition to optional raised glass sections 62, further raised glass sections 64 may also be included. Further raised glass sections may also be situated on opposite sides of pickup coil 60. Strings 20 thus may extend directly over further raised glass section 64. Furthermore, in accordance with a further exemplary embodiment of the present invention, raised glass sections 62 may extend from body 26 higher (and optionally above the height of strings 20) then do further raised glass sections 64.

As shown in FIG. 9, glass including material may be used for other portions of body 26. Thus, as shown in FIG. 9, pickup coil 60 may be covered by encasement 67 (which may also include glass materials). Pick guard 65 may also include glass materials and may be situated between pickup coil 60 and an edge of body 26. Other glass including materials may be used so that some or all of body 26 is covered with glass.

Figure 10:
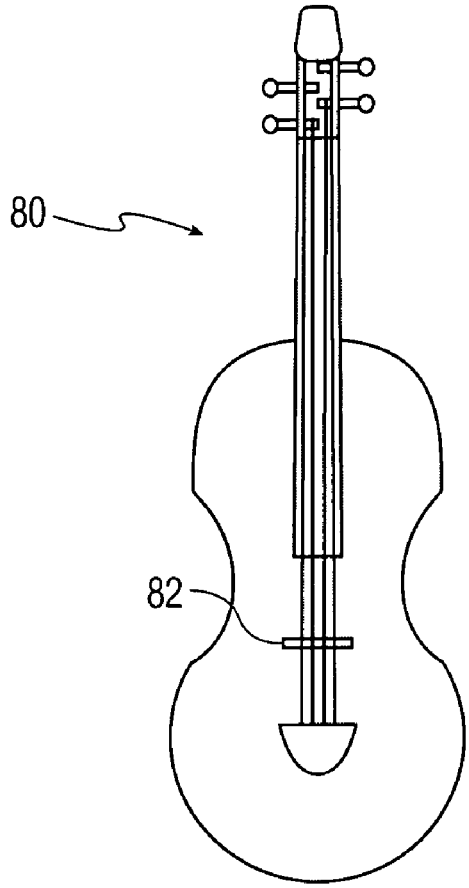
FIG. 10 is a top view of an orchestral stringed instrument in accordance with an exemplary embodiment of the present invention.

The above description as related to a guitar. The present invention, however, is equally applicable to other types of stringed instruments. FIG. 10 illustrates an orchestral stringed instrument (e.g. viola, violin, cello, base) in accordance with a further exemplary embodiment of the present invention. Orchestral instrument 80 differs from many guitars in that orchestral instrument 80 does not include frets. Also, orchestral instrument 80 includes bridge 82. In an exemplary embodiment of the present invention, bridge 82 includes glass materials. Bridges for orchestral instruments are known to one of ordinary skill in the art.

Figure 11:
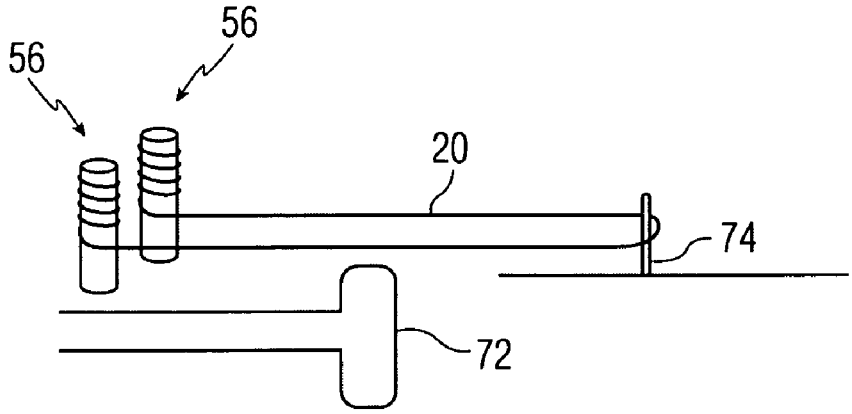
FIG. 11 is an interior view of a portion of a hammer actuated musical instrument.

FIG. 11 illustrates a further stringed instrument such as a piano. Thus, piano interior 70 is shown. Piano interior 70 includes hammer 72 which is actuated by operation of a key (not shown). Hammer 72 strikes string 20. String 20, at each end, is wrapped around tuning peg 56. In accordance with a further exemplary embodiment of the present invention, tuning peg 56 includes a glass cover so that string 20 is in contact with glass material as it is wrapped around tuning pegs 56. String 20 is held taunt by tension member 74. In a further exemplary embodiment of the present invention, tension member 74 includes glass materials.

Strings in musical instruments are well known in the art and are typically made of nylon or metal (e.g. steel). Alternatively, in a further exemplary embodiment of the present invention, the strings may include glass materials, i.e. glass fibers.

While various musical instruments have been described, it is understood that many details of those instruments have not been explained, as those materials are known to one of ordinary skill in the art. Furthermore, it is understood that glass materials can be used in a variety of locations for the musical instruments that have been described.

Although the invention is illustrated and described herein with reference to specific embodiments, the invention is not intended to be limited to the details shown. Rather, various modifications may be made in the details within the scope and range of equivalence of the claims and without departing from the invention.

What is claimed:

1. A stringed musical instrument, comprising:

a plurality of strings, each string being capable of being vibrated and producing sound;

a glass fingerboard portion comprising a glass saddle portion on one end of the glass fingerboard unit and a glass bridge portion on another end of the glass fingerboard portion, the glass fingerboard portion comprised of glass which is resin-free;

the glass fingerboard portion comprising a plurality of glass frets, each glass fret comprised of glass which is resin-free;

the glass saddle portion being in direct contact with each string, and the glass saddle portion comprised of glass which is resin-free; and the glass bridge portion being in direct contact with each string, and the glass bridge portion comprised of glass which is resin-free;

wherein the vibrating portion of each string is only permitted to be in direct contact with glass which is resin-free.

2. A stringed musical instrument according to claim 1, wherein the glass frets extend from the glass fingerboard portion, and the plurality of strings extend towards locations above opposite ends of the glass fingerboard portion.

3. A stringed musical instrument according to claim 1, wherein the glass saddle portion extends from the glass fingerboard portion towards the plurality of strings, the glass saddle portion maintained in contact with the plurality of strings.

4. A stringed musical instrument according to claim 1, wherein the glass saddle portion has an opening through which at least one of the plurality of strings extends.

5. A stringed musical instrument according to claim 1, wherein the glass fingerboard portion includes one or more glass tiles facing the plurality of strings, the one or more glass tiles comprising glass which is resin-free.

6. A stringed musical instrument according to claim 5, wherein the one or more glass titles form the glass fingerboard portion facing the plurality of strings.

7. A stringed musical instrument according to claim 1, further comprising a neck, the neck including the glass fingerboard with at least one extension member, the extension member engaging the neck to attach the glass fingerboard to the neck, so that an air gap is formed between the glass fingerboard and the neck.

8. A stringed musical instrument according to claim 7, the neck including glass that is resin-free.

9. A stringed musical instrument, according to claim 1, wherein the musical instrument is a guitar.

10. A stringed musical instrument according to claim 1, further including a tuning peg.

11. A stringed musical instrument according to claim 1, wherein the string includes glass.

12. A stringed musical instrument according to claim 1, further including a pickup coil, each string extending across the pickup coil, wherein a section of raised glass is in at least two locations around the pickup coil.

13. A stringed musical instrument according to claim 12, wherein the section of raised glass surrounds the pickup coil, the section higher for a portion running along a side of the string than a further portion extending directly under the string.

14. The stringed musical instrument of claim 12, wherein the section of raised glass is a pick guard.

15. The stringed musical of claim 12, wherein the section of raised glass comprises glass that is resin-free.

16. A stringed musical instrument according to claim 1, wherein the glass frets are situated between the glass saddle portion and the glass bridge portion, the plurality of glass frets each extending across the plurality of strings, the strings contactable with any of the frets so that vibration of any of the strings responsive to impact is further limited to a further portion of any strings situated between a contacted one of the frets and the glass saddle portion.

17. The stringed musical instrument of claim 1, wherein a specifically shaped orifice can be formed in a neck of the musical instrument and each fret can be slid into the orifice.

* * * * *